United States Patent [19]

Stahlecker et al.

[11] Patent Number: 4,962,633

[45] Date of Patent: Oct. 16, 1990

[54] TANGENTIAL BELT DRIVE FOR A SPINNING OR TWISTING MACHINE AND METHOD OF OPERATING SAME

[75] Inventors: Gerd Stahlecker, Eislingen/Fils; Klaus Hofstetter, Hochdorf, both of Fed. Rep. of Germany

[73] Assignee: Novibra GmbH, Fed. Rep. of Germany

[21] Appl. No.: 413,634

[22] Filed: Sep. 28, 1989

[30] Foreign Application Priority Data

Sep. 30, 1988 [DE] Fed. Rep. of Germany ..... 3833199

[51] Int. Cl.[5] ..... D01H 13/00

[52] U.S. Cl. ..... 57/105; 57/88; 474/135

[58] Field of Search ..... 57/105, 104, 88; 474/135, 101, 111, 117

[56] References Cited

U.S. PATENT DOCUMENTS

| | | | |
|---|---|---|---|
| 2,718,747 | 9/1955 | Honig | 57/104 X |
| 2,921,430 | 1/1960 | Scragg et al. | 57/104 X |
| 3,136,170 | 6/1964 | Murray | 474/135 |
| 3,333,408 | 8/1967 | Keyser | 57/104 |
| 3,461,660 | 8/1969 | Nimtz et al. | 57/105 |
| 3,645,084 | 2/1972 | Nimtz | 57/104 X |
| 4,627,228 | 12/1986 | Wolf | 57/105 X |

FOREIGN PATENT DOCUMENTS

| | | | |
|---|---|---|---|
| 1685951 | 9/1971 | Fed. Rep. of Germany . | |
| 3320458 | 12/1984 | Fed. Rep. of Germany . | |
| 2110247 | 6/1972 | France . | |
| 59-51606 | 12/1984 | Japan . | |
| 519032 | 3/1972 | Switzerland | 57/105 |

*Primary Examiner*—Joseph J. Hail, III

*Attorney, Agent, or Firm*—Evenson, Wands, Edwards, Lenahan & McKeown

[57] ABSTRACT

In the case of a tangential belt drive for a plurality of spindles of a spinning or twisting machine, which are arranged in a row, it is provided that, in each case, one pressure roller is arranged in the center between two spindles and deflects the tangential belt in the direction toward these two spindles. The pressure rollers are held in such a manner that when the pressure roller is in the operative position, they can be moved toward each of the two spindles assigned to them, approximately in parallel to the direction of the course of the tangential belt.

24 Claims, 2 Drawing Sheets

TANGENTIAL BELT DRIVE FOR A SPINNING OR TWISTING MACHINE AND METHOD OF OPERATING SAME

BACKGROUND AND SUMMARY OF THE INVENTION

The invention relates to a tangential belt drive for a plurality of spindles which are arranged in a row and are part of a spinning or twisting machine having pressure rollers which each are arranged approximately in the center between two spindles and deflect a tangential belt in the direction of these two spindles.

A tangential belt drive of the initially mentioned type is known on the basis of JP-AS 59-51606. In each case, one pressure roller is assigned to two spindles. In certain operating conditions, it is necessary to interrupt the drive. For this purpose, it is known in the case of a similar tangential drive according to FR-A 21 10 247 to provide lift-off rollers by means of which the tangential belt may be lifted off the pertaining spindles. Brakes are then simultaneously applied to the spindles. Lift-off rollers of this type result in increased expenditures and also subject the bearing of the pressure rollers to an additional load.

In the case of another known tangential belt drive according to DE-OS 16 85 951, a pressure roller, which is arranged in proximity of the spindle, is assigned to each of the spindles. This pressure roller can be moved away from the pertaining spindle in such a manner that the belt deflection is diminished and thus the driving force is reduced. The spindle may then be braked.

An object of the invention is to provide a tangential belt drive of the initially mentioned type in which, particularly for the purpose of braking, the driving force may be reduced to one spindle without the requirement of lift-off rollers which lead to an increased load on the pressure rollers.

This object is achieved by the fact that the pressure rollers are each held by means of a holding device in such a manner that when the pressure roller is in an operative position they can be moved in the direction toward each of the two spindles which are assigned to them, approximately in parallel to the direction of the course of the tangential belt.

By means of this construction, it is achieved that, in each case, one of the two spindles is largely relieved of the load by the tangential belt by means of a corresponding movement of the pressure roller, while the load with respect to the other spindle practically does not change. The relieved spindle may then be braked in a simple manner. Since the pressure roller moves essentially in parallel to the course of the tangential belt, when the pressure roller is in the operative position, the wrap with respect to the spindle which is approached by the pressure roller does not change or does not change significantly, while the angle of wrap of the tangential belt at the spindle, from which the pressure roller moves away, is reduced significantly. In this manner, it is possible to relieve one spindle from the load to an extent which is sufficient for braking, while the driving conditions with respect to the other spindle remain practically unchanged.

In a further development of preferred embodiments of the invention, it is provided that the pressure rollers are each arranged on a swivel arm which can be swivelled around a shaft which is in parallel to the spindle shafts. This shaft of the swivel arm may easily be arranged such that the circular-arc movement follows essentially the direction of the course of the tangential belt when the pressure roller is in operative position. Slight deviations from this course have no significance in practice, particularly if these operating conditions occur only for a short time.

Other objects, advantages and novel features of the present invention will become apparent from the following detailed description of the invention when considered in conjunction with the accompanying drawings.

DETAILED DESCRIPTION OF THE DRAWINGS

Figure 1:
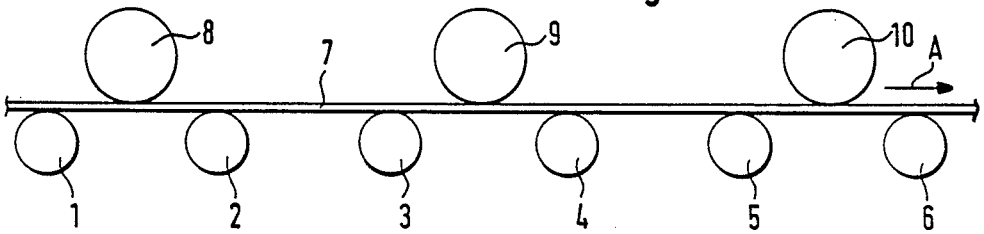
FIG. 1 is a schematic representation of a tangential belt drive constructed according to a preferred embodiment of the invention.

FIG. 1 shows a total of six spindles 1, 2, 3, 4, 5, 6 of a spinning or twisting machine which are arranged on one side of the machine in a row behind one another. These spindles 1 to 6 are driven by a common tangential belt 7 which travels in the direction of the arrow (A), i.e., in the longitudinal direction of the machine. This tangential belt 7 can drive the spindles on one side of the machine or both sides of the machine, in each case, along the whole length of the machine.or over only part of this length.

Figure 2:
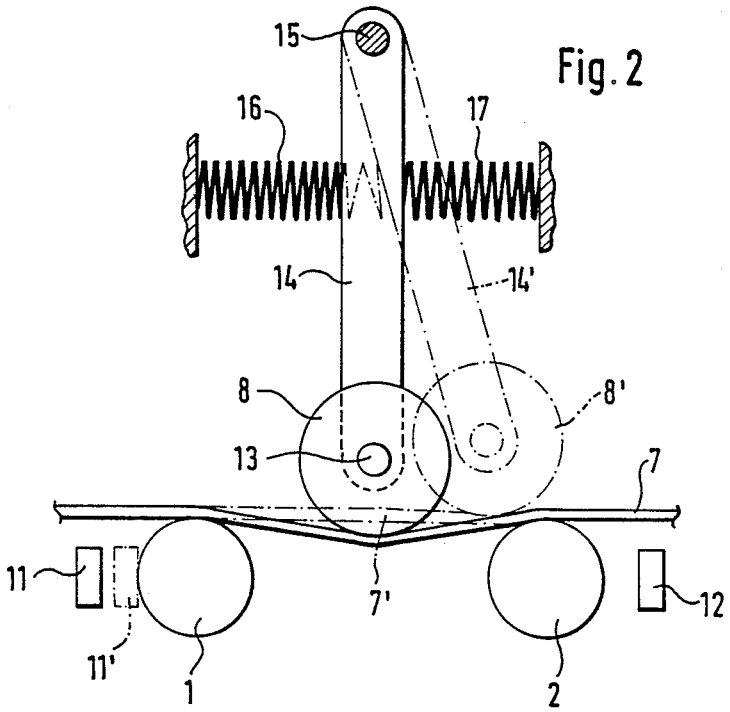
FIG. 2 is an enlarged view of a detail of a tangential belt drive constructed according to a preferred embodiment of the invention with a pressure roller which is assigned to two spindles and, for relieving one spindle from the load, can be moved out of its central position.

Approximately in the center between, in each case, two spindles 1, 2; 3, 4; 5,6, a pressure roller 8, 9, 10 is arranged which, with respect to the spindles 1 to 6, is arranged on the opposite side of the tangential belt 7 and which deflects the tangential belt 7 in the direction of the spindles 1 to 6. In each case the pressure roller 8, 9, 10 deforms the belt in the direction between the spindle pairs 1, 2; 3, 4; 5, 6, as shown in FIG. 2. The tangential belt 7 wraps itself around a portion of all spindles 1 to 6 in the same manner, so that a uniform drive is ensured.

As shown in FIG. 2 in the example of pressure roller 8, the pressure rollers 8, 9, 10 are held in such a manner that they can be moved selectively toward one of the spindles 1, 2 assigned to them; i.e., for example, toward spindle 2 into position 8'. Pressure roller 8 is freely rotatably disposed on a shaft 13 of the swivel arm 14 which itself can be pivoted around a shaft 15 which is in parallel to the spindles 1, 2. The shaft 15 has equal distance to spindles 1, 2 so that, in the operative position shown by drawn-out solid lines, the pressure roller 8 is located in the center between spindles 1, 2. This center position of the pressure roller 8 is secured by prestressed springs 16, 17 which are applied to the swivel arm 14, are directed against one another and support themselves with their other ends, in each case, at stationary structural members.

The distance of the shaft 15 from the spindles 1, 2, i.e., the length of the swivel arm 14 is selected such that, when the swivel arm 14 is swivelled, the pressure roller 8 moves toward one of the two spindles 1, 2, for example, into position 14' toward spindle 2 along a curve which is essentially in parallel to the course of the tangential belt 7 shown by drawn-out solid lines which the tangential belt 7 takes up in the operative position of the pressure roller 8, i.e., in its center position.

The tangential belt will then have the shape of a flat V. The swivel path, on which the pressure roller 8 moves into position 8', will then approximate the course of one leg of this V. As a result, it is achieved that the angle of wrap, by which the tangential belt 7 wraps itself around the spindle 2 to which the pressure roller 8 was applied, practically does not change. However, on the other side, with respect to spindle 1, the tangential belt 7 takes up the course 7' which is shown by a dash-dotted line and in which it has a clearly smaller angle of wrap with respect to the spindle 1 and can transmit correspondingly less driving force. The tangential belt 7 is therefore relieved from the load at spindle 1 so that a brake 11, which is moved into position 11', can brake spindle 1, without the requirement of having to counteract an excessive amount of driving power in this case. A brake 12 is assigned to spindle 2 in a mirror-inverted manner with respect to brake 11.

In a manner not shown in detail, the brakes 11, 12 are coupled with the swivel arm 14 of the pressure roller 8 by means of a lever mechanism so that a movement in the same direction takes place in each case; i.e., when the pressure roller 8 is moved into position 8', brake 11' is applied to spindle 1, while, in the case of a reversed movement, brake 12 is assigned to spindle 2. An actuating mechanism may, for example, be constructed corresponding to DE-OS 33 20 458, in which a brake is applied also alternately to two adjacent spindles. In that case, it is naturally also possible to arrange the brakes 11, 12 between the two spindles 1, 2.

Figure 3:
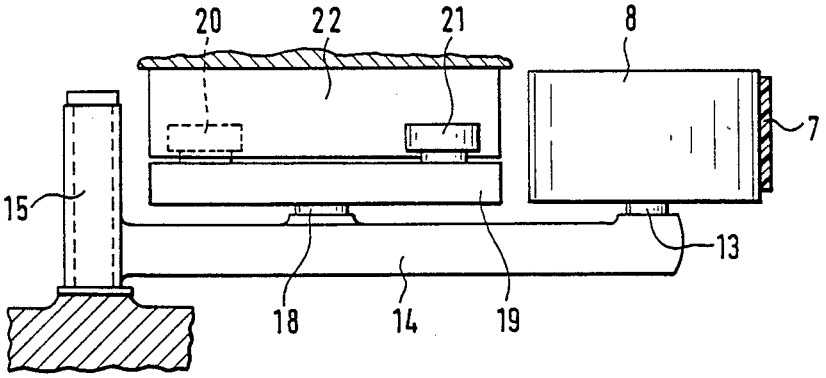
FIG. 3 is a view in longitudinal direction of a tangential belt of a holding device of a pressure roller, constructed according to a preferred embodiment of the invention.
Figure 4:
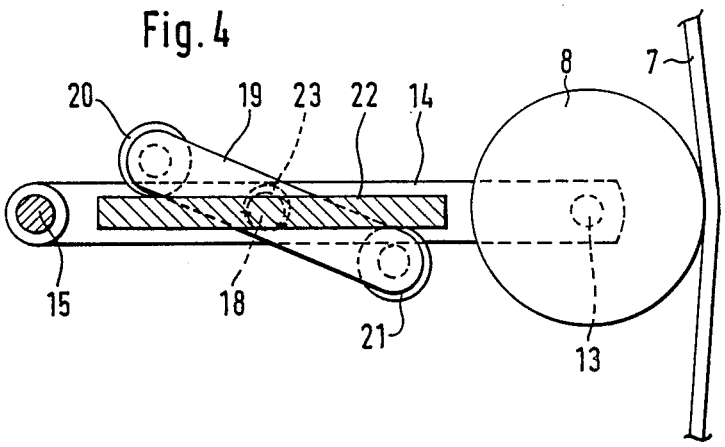
FIG. 4 is a partially sectional representation of the holding device according to FIG. 3.

In the embodiment according to FIG. 3 and 4, a turning lever 19 is fastened to the swivel arm 14 by means of a shaft 18 which is parallel to the shaft 15, this turning lever 19, at both of its ends, being equipped with rollers 20 and 21 serving as stops. These rollers 20, 21 accommodate between one another a strip-shaped stop 22 which, in the center position, extends in the direction of the swivel arm 14 and which is arranged in a stationary manner. The turning lever 19 is loaded counterclockwise by a spring force by means of a torsion spring element 23 which is only outlined. When the swivel arm 14 is swivelled, the turning lever 19, in each case, is turned clockwise so that always an elastic restoring force exists which moves the swivel arm 14 with the pressure roller 8 back into the center position.

It is contemplated to achieve the movement of the pressure rollers 8, 9, 10 during the application to the pertaining spindles 1, 2 or 3, 4 or 5, 6 corresponding to the operational course of the tangential belt 7 also by other means. It is contemplated, for example, to provide a connecting link guide which, corresponding to the course of the tangential belt, is shaped in a flat V, the shaft 13 of a pressure roller 8, 9 or 10 being guided in this connecting link guide and, in that case, not being arranged on a swivel lever.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A tangential belt driving arrangement for a plurality of textile machine spindles arranged in a row, comprising:

a tangential driving belt having a travel section extending past a plurality of spindle shafts, a pressure roller arranged approximately in the center between two spindle shafts, and pressure roller moving means for moving the pressure roller to deflect the tangential belt in a direction forcing the tangential belt into driving engagement with the two spindle shafts, wherein the pressure roller means includes means for moving the pressure roller in a path substantially parallel to the travel path of the driving belt between a first position with the pressure roller forcing the driving belt with substantially equal driving force toward both of the spindle shafts and with a corresponding equal partial wrapping of the spindle shafts by the driving belt and a second position with the second roller continuing to force the driving belt with substantially unchanged driving force toward one of the pressure rollers while relieving the driving belt driving force and extent of partial wrapping at the other pressure roller, thereby permitting braking of the other pressure roller in a simple manner without interrupting the driving of the one pressure roller.

2. A tangential belt driving arrangement according to claim 1, wherein a plurality of pairs of respective first and second spindle shafts are disposed along the driving belt travel section, and wherein a corresponding plurality of said pressure rollers are provided for deflecting the driving belt toward the respective spindle shafts.

3. A tangential belt driving arrangement according to claim 1, wherein the pressure roller moving means includes a swivel arm which carriers the pressure roller.

4. A tangential belt driving arrangement according to claim 3, wherein a plurality of pairs of respective first and second spindle shafts are disposed along the driving belt travel section, and wherein a corresponding plurality of said pressure rollers are provided for deflecting the driving belt toward the respective spindle shafts.

5. A tangential belt driving arrangement according to claim 3, wherein a swivel arm pivot shaft is provided which extends parallel to the spindle shafts, and wherein the swivel arm is mounted for pivotal movement at the pivot shaft.

6. A tangential belt driving arrangement according to claim 5, wherein a plurality of pairs of respective first and second spindle shafts are disposed along the driving belt travel section, and wherein a corresponding plurality of said pressure rollers are provided for deflecting the driving belt toward the respective spindle shafts.

7. A tangential belt driving arrangement according to claim 6, wherein spring elements are provided which act on the swivel arm to bias the pressure roller to the first position.

8. A tangential belt driving arrangement according to claim 6, wherein a turning lever is arranged on the swivel arm which can be rotated around a shaft which is parallel to the shaft of the swivel arm, said turning lever including two lever stops mounted at its ends, and wherein a stationary stop engageable by the two lever stops and spring tension means acting on the turning lever to hold the swivel arm in its normal central position.

9. A tangential belt driving arrangement according to claim 5, wherein spring elements are provided which act on the swivel arm to bias the pressure roller to the first position.

10. A tangential belt driving arrangement according to claim 5, wherein a turning lever is arranged on the swivel arm which can be rotated around a shaft which is parallel to the shaft of the swivel arm, said turning lever including two lever stops mounted at its ends, and wherein a stationary stop engageable by the two lever stops and spring tension means acting on the turning lever to hold the swivel arm in its normal central position.

11. A tangential belt driving arrangement according to claim 10, wherein a plurality of pairs of respective first and second spindle shafts are disposed along the driving belt travel section, and wherein a corresponding plurality of said pressure rollers are provided for deflecting the driving belt toward the respective spindle shafts.

12. A tangential belt driving arrangement according to claim 1, wherein the pressure roller moving means includes a restoring device for returning the pressure roller to the first position.

13. A method of operating a tangential belt driving arrangement for a plurality of textile machine spindles arranged in a row, comprising:

disposing a tangential driving belt to have a travel section extending past a plurality of spindle shafts, disposing a pressure roller arranged approximately in the center between two of the spindle shafts, and moving the pressure roller to deflect the tangential belt in a direction forcing the tangential belt into driving engagement with the two spindle shafts, wherein the moving the pressure roller includes moving the pressure roller in a path substantially parallel to the travel path of the driving belt between a first position with the pressure roller forcing the driving belt with substantially equal driving force toward both of the spindle shafts and with a corresponding equal partial wrapping of the spindle shafts by the driving belt and a second position with the second roller continuing to force the driving belt with substantially unchanged driving force toward one of the pressure rollers while relieving the driving belt driving force and extent of partial wrapping at the other pressure roller, thereby permitting braking of the other pressure roller in a simple manner without interrupting the driving of the one pressure roller.

14. A method according to claim 13, wherein a plurality of pairs of respective first and second spindle shafts are disposed along the driving belt travel section, and wherein a corresponding plurality of said pressure rollers are provided for deflecting the driving belt toward the respective spindle shafts.

15. A method according to claim 13, wherein the pressure roller moving includes moving a swivel arm which carries the pressure roller.

16. A method according to claim 15, wherein a plurality of pairs of respective first and second spindle shafts are disposed along the driving belt travel section, and wherein a corresponding plurality of said pressure rollers are provided for deflecting the driving belt toward the respective spindle shafts.

17. A method according to claim 15, wherein a swivel arm pivot shaft is provided which extends parallel to the spindle shafts, and wherein the swivel arm is mounted for pivotal movement at the pivot shaft.

18. A method according to claim 17, wherein a plurality of pairs of respective first and second spindle shafts are disposed along the driving belt travel section, and wherein a corresponding plurality of said pressure rollers are provided for deflecting the driving belt toward the respective spindle shafts.

19. A method according to claim 18, wherein spring elements are provided which act on the swivel arm to bias the pressure roller to the first position.

20. A method according to claim 18, wherein a turning lever is arranged on the swivel arm which can be rotated around a shaft which is parallel to the shaft of the swivel arm, said turning lever including two lever stops mounted at its ends, and wherein a stationary stop engageable by the two lever stops and spring tension means acting on the turning lever to hold the swivel arm in its normal central position.

21. A method according to claim 11, wherein spring elements are provided which act on the swivel arm to bias the pressure roller to the first position.

22. A method according to claim 17, wherein a turning lever is arranged on the swivel arm which can be rotated around a shaft which is parallel to the shaft of the swivel arm, said turning lever including two lever stops mounted at its ends, and wherein a stationary stop engageable by the two lever stops and spring tension means acting on the turning lever to hold the swivel arm in its normal central position.

23. A method according to claim 22, wherein a plurality of pairs of respective first and second spindle shafts are disposed along the driving belt travel section, and wherein a corresponding plurality of said pressure rollers are provided for deflecting the driving belt toward the respective spindle shafts.

24. A method according to claim 13, wherein the pressure roller moving includes using a restoring device for returning the pressure roller to the first position.

* * * * *